US009061438B2

(12) United States Patent
Gebhart et al.

(10) Patent No.: US 9,061,438 B2
(45) Date of Patent: Jun. 23, 2015

(54) DEVICE AND METHOD FOR ARTIFICIAL AGING OF STONES

(71) Applicants: Hans Gebhart, Memmingen (DE); Manfred Staehle, Legau (DE)

(72) Inventors: Hans Gebhart, Memmingen (DE); Manfred Staehle, Legau (DE)

(73) Assignee: Baustoffwerke Gebhart & Soehne GmbH & Co. KG, Lachen (DE)

( * ) Notice: Subject to any disclaimer, the term of this patent is extended or adjusted under 35 U.S.C. 154(b) by 0 days.

(21) Appl. No.: 14/351,886

(22) PCT Filed: Oct. 16, 2012

(86) PCT No.: PCT/EP2012/070463
§ 371 (c)(1),
(2) Date: Apr. 15, 2014

(87) PCT Pub. No.: WO2013/057091
PCT Pub. Date: Apr. 25, 2013

(65) Prior Publication Data

US 2014/0251297 A1 Sep. 11, 2014

(30) Foreign Application Priority Data

Oct. 17, 2011 (DE) ..... 10 2011 084 656

(51) Int. Cl.

| | |
|---|---|
| ***B24B 31/05*** | (2006.01) |
| ***B24B 31/06*** | (2006.01) |
| ***B28D 1/00*** | (2006.01) |
| ***B28D 1/26*** | (2006.01) |

(52) U.S. Cl.
CPC . *B28D 1/006* (2013.01); *B28D 1/26* (2013.01)

(58) Field of Classification Search
CPC ..... B24B 31/027; B24B 31/03; B24B 31/05; B24B 31/06; B24B 31/062; B24B 31/067; B24B 31/073; B24B 31/108; B28D 1/006; B28D 1/008
USPC ..... 451/32, 34, 35, 103, 326; 125/1
See application file for complete search history.

(56) References Cited

U.S. PATENT DOCUMENTS

| | | | | |
|---|---|---|---|---|
| 3,871,135 | A * | 3/1975 | Anderson | 451/326 |
| 4,402,162 | A * | 9/1983 | Kobayashi | 451/327 |
| 4,586,293 | A * | 5/1986 | De Spain et al. | 451/36 |
| 4,829,714 | A * | 5/1989 | Crouch et al. | 451/104 |
| 4,991,360 | A * | 2/1991 | DeSpain | 451/36 |
| 6,210,258 | B1 * | 4/2001 | Malkin et al. | 451/74 |
| 6,279,291 | B1 * | 8/2001 | Geusens et al. | 52/741.1 |
| 2006/0073775 | A1 * | 4/2006 | Rothdach | 451/113 |
| 2006/0080938 | A1 * | 4/2006 | Rothdach et al. | 52/749.13 |

(Continued)

FOREIGN PATENT DOCUMENTS

| | | |
|---|---|---|
| DE | 2206732 A1 | 8/1973 |
| DE | 3332041 A1 | 3/1985 |

(Continued)

*Primary Examiner* — Eileen Morgan
(74) *Attorney, Agent, or Firm* — GrayRobinson, PA

(57) ABSTRACT

Device for the artificial aging of stones with at least an aging channel arranged on a support, a vibration device to set the support in motion, and a conveying device to move the stone through the aging channel. The aging channel has at least a first and a second impacting surface, which apply the aging effect to the stone. The aging channel comprises at least two sections, wherein the stone moves through a first section in a first feed direction and wherein a second section runs at an angle to the first section, so the stone is deflected in its feed direction to move into a second feed direction.

21 Claims, 6 Drawing Sheets

(56) References Cited

U.S. PATENT DOCUMENTS

| | | | | |
|---|---|---|---|---|
| 2006/0112946 | A1* | 6/2006 | Kitahara | 125/23.01 |
| 2006/0288658 | A1* | 12/2006 | Gebhart et al. | 52/596 |
| 2007/0001340 | A1* | 1/2007 | Clijsters et al. | 264/162 |

FOREIGN PATENT DOCUMENTS

| | | | |
|---|---|---|---|
| DE | 3347077 | A1 | 7/1985 |
| EP | 1 699 609 | B1 | 9/2006 |
| WO | 2005/063457 | A1 | 7/2005 |

* cited by examiner

DEVICE AND METHOD FOR ARTIFICIAL AGING OF STONES

CROSS-REFERENCE TO RELATED APPLICATIONS

This application claims priority under 35 U.S.C. Sections 119(a)-(d), 120, 363 and 365 to International Patent Application No. PCT/EP2012/070463, filed Oct. 16, 2012 which designated the United States and at least one other country in addition to the United States and claimed priority to German Application No. 10 2011 084 656.5 filed Oct. 17, 2011. International Patent Application No. PCT/EP2012/070463, and German Application No. 10 2011 084 656.5 are both expressly incorporated by reference herein in their entireties to form a part of the present disclosure.

FIELD OF THE INVENTION

The invention relates to a device for the artificial aging of stone blocks. The invention also relates to a method for the artificial aging of stone blocks.

BACKGROUND OF THE INVENTION

Walls, above all those used in landscape architecture, are preferably made from natural or artificial stone blocks which, on their visible side, are provided with an irregular relief surface structure and/or broken edges, such as those created, for example, by manual hewing of natural stone blocks.

It is also known in this context to employ split stone blocks, preferably made of concrete. Here, raw stone blocks obtained from stone-block production can be fed in layers to a splitting device in which the raw stone blocks are preferably divided in half. The split stone blocks created in this fashion are often referred to as split blocks. As a result of the dividing process, such split blocks have an irregular relief surface structure on the side on which they have been broken. DE 22 06 732 discloses a method and a device for splitting raw blocks of artificial stone. Furthermore, DE 33 32 041 A1 and DE 33 47 077 A1 disclose devices for manufacturing embossed split blocks.

It is frequently demanded of the split blocks, both when made of concrete and when in the form of split natural stone blocks, that they should have no sharp edges. Independent of this, a further treatment of the broken structure is also frequently requested. To this end, devices for the aging of stone blocks are known from the general prior art. In this context, reference is made, for example, to EP 1 699 609 B1. Beyond this, a multiplicity of further methods for the aging of stone blocks are known from the general prior art.

In the aging of stone blocks, in particular where split blocks are concerned, the problem arises that the face of the stone block which is to be machined, i.e. typically the visible side of the stone block at a later stage, does not form the upper side of the stone block after exiting production. In the case of what are referred to as split blocks, this is a result of said split blocks typically being formed from one raw stone block or block in that said block is divided into two halves. Such splitting methods are adequately known from the general prior art, e.g. from DE 22 06 732. Splitting of the raw block into two split blocks has the effect that the split faces of the stone blocks created are arranged on the sides and are oriented toward one another.

For machining the face created by splitting or in order to machine stone blocks in general in which the face to be machined is oriented toward the side, two different methods are known. One possibility consists in using aging methods which enable machining of the sides of stone blocks by means of corresponding machining tools. Such methods, however, are complex and not efficient. To this end it is known, for example, to fasten chain beaters which beat the side face of the stone block to a rotating roller. In the case of split blocks, the stone blocks having the broken faces which are oriented toward one another have first to be spatially separated from one another to the extent that the machining tools are in a position to engage in the first place. The second possibility for further processing or aging side faces of stone blocks consists in that the latter are raised by means of corresponding gripping tools and lowered, such that the face to be machined forms the upper side of the stone block.

Raising and re-lowering of stone blocks has the disadvantage that it is expensive, prone to disruptions and time-consuming. On the other hand, however, this does allow the employment of effective and known aging methods which act upon the surface of stone blocks. A multiplicity of aging methods which act upon the surface of the stone blocks are known from the general prior art. A particularly suitable method is derived from EP 1 699 609 B1.

Stone blocks which are machined on one side face that, in the constructed or laid state of the stone block, runs at an angle of 90° in relation to the upper side of the stone block are not necessarily split blocks. It may be advantageous in the case of other stone blocks in which a side face later forms the visible face to age this, too. Here the problem also consists in that the sideways oriented side of the stone block, which at a later stage forms the visible side of the stone block, is not identical with the upper side of the stone block and, therefore, cannot be aged as effectively as is possible in the case of the upper side of the stone block.

SUMMARY OF THE INVENTION

It is the object of the present invention to provide a device and a method for the aging of stone blocks, in particular of split blocks, which both make it possible for stone blocks to be aged rapidly, economically, effectively and reliably.

This object, with respect to the device, is achieved according to the invention by claim 1. This object, with respect to the method, is achieved according to the invention by claim 19.

In the device according to the invention for the aging of stone blocks, in particular of concrete blocks, clinker bricks and natural stone blocks, a base and at least one aging duct which is arranged on the base and on which the stone blocks can be laid in such a manner that a side face of the stone block, which is to be machined, is oriented toward the side are provided. The side face to be machined of the stone block is delimited by a horizontally running stone-block lower edge, a horizontally running stone-block upper edge, a front vertically running stone-block edge and a rear vertically running stone-block edge. According to the invention, a vibration unit for setting the base in motion is furthermore provided. The aging duct has at least one first and one second impact face, wherein the stone block, on account of the motion of the base, impacts on the impact faces in such a manner that the impact faces act upon the stone block in an aging manner, wherein the first impact face is oriented toward the horizontally running stone-block lower edge and the second impact face is oriented toward the horizontally running stone-block upper edge. According to the invention, the first and the second impact faces are arranged such that the first impact face also machines a part-face of the side face which adjoins the horizontally running stone-block lower edge and an adjoining part-face of a lower side of the stone block. The second impact face is oriented in such a manner that it, in addition to the horizontally running stone-block upper edge, also machines adjoining part-faces of the side face and of the upper side of the stone block. The aging duct according to the invention has at least two portions, wherein the stone block passes through a first portion in a first indexing direction and wherein a second portion runs at an angle in relation to, i.e. does not run parallel to, the first portion, such that the stone block is deflected and moves in a second indexing direction. The two indexing directions are, therefore, not on one axis. According to the invention, a conveying unit for conveying the stone block through the aging duct is furthermore provided.

The feature of "side face to be machined" is not to be understood to mean that it is mandatory for the entire side face to be machined. In the case of many applications it is already sufficient for the stone-block edges which delimits the side face to be machined to be machined. Machining of only the stone-block edges is to be understood within the scope of the invention to be machining of the correspondingly delimited side face.

The inventor has recognized that the result of the device according to the invention is particularly effective aging of the side face of a stone block. The invention is suited to the machining of a side face of any stone block. However, the invention is preferably suited to machining split blocks, in particular the face of a split block which will be visible at a later stage.

The device according to the invention enables the machining or aging of the horizontally running stone-block lower edge, the horizontally running stone-block upper edge, the front vertically running stone-block edge and the rear vertically running stone-block edge of a side face to be machined of the stone block. The energy required for aging here is supplied by a vibration unit which is preferably arranged below the base onto which the stone blocks are laid. The vibration unit may have one or more vibration subassemblies. It is also possible to employ a vibration table. It has proven to be particularly advantageous within the scope of the invention for vibrating to take place in such a manner that the stone blocks are pushed upward by the base. The stone blocks thus jump upward in the aging duct.

It is particularly advantageous according to the invention for vibration to take place in the vertical direction. However, it is also possible, in principle, for the vibration unit to also generate, additionally or alternatively to the vertical component, lateral vibration and/or vibration in and opposite to the indexing direction. However, it is advantageous for the main vibration direction to be vertically oriented.

On account of the aging duct which is configured on the base having at least one first and one second impact face which are oriented, according to the invention, toward the horizontally running stone-block lower edge and the horizontally running stone-block upper edge, both horizontal edges are machined and thus aged. This takes place in that the stone blocks in the aging duct jump due to the vibration energy and specifically so preferably mainly upward and downward. The stone blocks, with the stone-block upper edge, thus impact on the second impact face when the stone block is pushed upward. When falling down again, but also when being pushed away, the stone-block lower edge impacts on the first impact face. The desired aging result can be influenced by the intensity of vibration. The aging result can furthermore be influenced by the duration of vibration. The stone-block upper edge and the stone-block lower edge can thus be freely aged as required.

For aging the vertically running stone-block edges, it is provided that the aging duct has at least two, preferably at least three portions. The stone block here initially passes through the first portion in a first indexing direction. According to the invention, the subsequent second portion runs at an angle in relation to the first portion, such that the stone block is deflected in its indexing direction and moves in a second indexing direction. This leads to a preceding stone block changing its direction in relation to a following stone block. Depending on the direction (to the left or to the right) in which the second portion runs at an angle in relation to the first portion, one of the two vertical rear stone-block edges of the stone block will move backward when viewed in relation to the other vertical rear stone-block edge. When viewed in the indexing direction, one vertically running stone-block edge of the stone block thus projects in a rearward manner when compared with the other stone-block edge. This leads to a following stone block striking against the rearward projecting vertical stone-block edge of the preceding stone block.

It has been established in experiments that it is in particular the vertically running front edge of the following stone block which is configured on the same side of the stone block that impacts on the rearward projecting vertically running stone-block edge of the preceding stone block. As a consequence, a rear vertically running stone-block edge of a preceding stone block and a front vertically running stone-block edge of a following stone block mutually one another. Depending on the intensity of vibration and depending on how pronounced the bend or change of direction is which is generated by the two portions of the aging duct which are at an angle in relation to one another, almost any aging result can be achieved on the two vertically running stone-block edges.

It is advantageous here for the aging on the vertically running stone-block edges to be generated by the stone blocks themselves. In this manner, it is possible to achieve an aged appearance that comes very close to or exceeds the aging in a stone drum. Since no further materials are involved, wear and tear of the aging duct is also low in this respect.

In the case of the following stone block, aging of the vertically running front stone-block edge is achieved by the preceding stone block, as has been described above. In an analogous manner, it is achieved in the case of the following stone block by another following stone block that the vertically running rear stone edge of the former is also aged.

The device according to the invention makes it possible, using simple measures, for a front vertically running stone-block edge and a rear vertically running stone-block edge to be machined or aged. This can be achieved with only a single change of direction within the aging duct.

As has also already been mentioned, the horizontally running stone-block edges (stone-block lower edge and stone-block upper edge) are aged by the impact faces. Therefore, all encircling edges of a side face to be aged are aged. As already mentioned, the side face to be aged represents the visible face at a later stage, for example in a wall, in particular in the case where the former is a split block. It is sufficient in many cases for only the afore-described side edges which surround or delimit the side face or the visible face of the stone block at a later stage to be aged. If it is the intention to also age that side face of the stone block that faces away from the side face to be machined, this can be achieved by way of the following measures.

It may be provided in one embodiment of the invention, in particular for the aging of two side faces, that the aging duct has at least one third portion. The third portion here may run at an angle in relation to the second portion, such that the stone block is in turn deflected and moves in a third indexing direction. It may be provided here according to the invention that the deflection imparted to the stone block when the stone block is moved from the second portion into the third portion takes place in the opposite direction to the deflection of the stone block when entering into the second portion. For example, the stone block, when moving from the first portion into the second portion, may be deflected toward the left and, when moving from the second into the third portion, toward the right (or vice versa). On account of this it is achieved that also those vertically running stone-block edges of the stone block that were not aged in the process of the first deflection or the first change of direction of the stone block are aged.

It may be provided according to the invention that the deflection between the first and the second portion is reversed again by way of the angled arrangement of the third portion in relation to the second portion. It may be provided here that the first indexing direction corresponds to the third indexing direction, i.e. that the indexing directions run parallel to one another. This is, however, optional. A design of this type may be appropriate, inter alia, in order to arrange the aging duct on the base in a particularly space-saving manner or in order to push the stone blocks through the aging duct in as unimpeded a manner as possible by means of an indexing member, for example a conveying ram.

It may be provided according to the invention for the aging of all horizontal stone-block edges (two upper horizontally running stone-block edges and two lower horizontally running stone-block edges) that, in addition to the already described first and second impact faces, third and fourth impact faces, which are correspondingly oriented toward the horizontally running stone-block edges which have to be additionally aged, are provided.

Within the scope of the invention, the terms "horizontally running stone-block lower edge" or "stone-block upper edge" are to be understood to mean the stone-block lower edges and stone-block upper edges which, when the stone block is being conveyed through the aging duct, run horizontally and laterally to the stone block, i.e. those stone-block upper edges and stone-block lower edges which, when viewed in the indexing direction, extend from the front to the rear. Within the scope of the present invention it is, in general, not relevant for the horizontally running stone-block edges on the front side and on the rear side of the stone block, i.e. those stone-block edges which run transversely to the indexing direction, to be aged also. The transversely running stone-block edges are aged by the device according to the invention substantially only in that region in which the former intersect with the laterally running stone-block lower edges and stone-block upper edges.

It is advantageous for the aging duct to have at least one first side wall which configures the first and/or the second impact face. It can be advantageous here for the side wall, when viewed in the cross section, to run from bottom to top in the shape of an arc. The side wall may preferably be configured in the shape of a divided circle or a semicircle. The side wall may be configured as a channel or as a piece of pipe cut in the longitudinal direction, so that a part of a piece of pipe is created. Channels or pieces of pipe cut longitudinally have proven particularly suited to the implementation of the invention. On the one hand, they can be manufactured economically. On the other hand, as a result of the shape of the piece of pipe cut longitudinally or, in general terms, of a piece of pipe which, when viewed in its cross section, has the shape of a divided circle, a stone block which is to be conveyed through the aging duct is embraced in the region of its stone-block lower edge and in the region of its stone-block upper edge. In this manner, corresponding impact faces which age the stone-block lower edge and the stone-block upper edge can be configured on a part of a piece of pipe by way of a simple design. This is possible in a particularly simple manner when abrasive elements are arranged in one of the aforementioned parts of a piece of pipe in such a manner that the stone-block lower edge and the stone-block upper edge rub or impact on said abrasive elements. The abrasive elements may be configured, for example, by way of welding beads or the like. This is particularly suitable in the case where the piece of pipe is a piece of metal pipe.

It may be generally advantageous for the lower region of the side wall to be bent in such a manner that, when the stone block passes through the aging duct, the first impact face which is configured there embraces both the horizontally running stone-block lower edge of a stone block and also the adjoining part-faces of the side face and the lower side of the stone block. The upper region of the side wall may preferably be configured in such a manner that said upper region embraces both the horizontally running stone-block upper edge and also the adjoining part-faces of the side face and of the surface of the stone block.

A configuration of this type can be achieved in a particularly simple manner if a correspondingly bent side wall, in particular in the form of a piece of a pipe in the shape of a divided circle, for example also in the shape of a semicircle, is used. A configuration of the side wall using metal, in particular steel, is particularly suitable.

It is generally advantageous for the impact faces to be configured with abrasive elements and/or tips and/or protrusions and/or welding points and/or welding beads or welding seams and/or an irregular structure.

In one advantageous refinement of the invention, additional impact members, which are positioned in a stationary manner and/or are positionable in a controlled manner, can be provided, such that, on account of the vibration motion of the base, bevels and/or recesses and/or angles of the side face of the stone block to be machined impact on said additional impact members.

The impact members and/or their impact points intended for impacting may be, independently of their specific configuration, preferably formed from metal, in particular from a hard metal, for example steel.

The impact members may be, for example, designed in the fashion of a scale or a shingle, wherein said impact members are preferably oriented in such a manner that their surface formed by a multiplicity of scales or shingles is oriented in the opposite direction to the direction of material flow, so that the stone blocks impact on them particularly well or hard. The impact member may be preferably attached on a side wall, for example in a vertically running manner. The impact member may also project into the conveying path of the stone blocks through an opening in the side wall or in the aging duct. The impact members may optionally be configured to be elastic or flexible or be elastically or flexibly fastened. The impact members may be designed or arranged in such a manner that only the corners or edges of the stone blocks impact on said impact members. However, it may be advantageous for the impact members to project so far into an indexing path/conveying path of the stone block that the duct which is available for conveying is constricted to the extent that the impact member also machines the side face to be machined or that at least unwanted protrusions or bulges of the side face are machined.

Alternatively or additionally, additional impact members, which are positioned by means of an elastic or flexible element in such a manner that, on account of the vibration motion of the base, bevels and/or recesses and/or angles and/or bulges and/or protrusions of the side face to be machined impact thereon, can be provided, and/or the aging duct is constricted by the additional impact members such that the stone blocks are pressed against the impact members, wherein, on account of the elastic or flexible element, the impact members yield when the stone block is conveyed through the aging duct in the indexing direction.

The elastic or flexible element may be any type of spring or a rubber or an elastomer, for example in the form of a block. It may be provided in one embodiment of the invention that the impact members vibrate.

It is advantageous for the aging duct to have at least one pair of impact members, wherein a first impact member is oriented toward the side face to be machined and a second impact member is oriented toward that side face of the stone block that faces away from the side face to be machined, such that the stone block passes through between the impact members. A particularly preferable arrangement of the aging members may provide that the side wall has an opening through which the impact members can be introduced into the indexing path of the stone blocks. Alternatively, it may also be provided that the impact members are positioned at the beginning or preferably at the end of the aging duct.

A particularly advantageous configuration of the impact members provides that the impact members are configured in a substantially cylindrical manner and are in each case arranged about a vertical rotation axle. The arrangement here may be such that the cylindrical impact member can rotate about the rotation axle. It is advantageous here for the rotation axle and thus also the cylindrically configured impact member to run in a vertical manner. The impact member here advantageously extends in the vertical direction across the height of the side face of the stone block, which is to be machined. The height of the impact member may approximately correspond to the height which is available for conveying a stone block through the aging duct. On account of the cylindrically designed impact member being rotatable about the rotation axle, the impact member can rotate when it comes into contact with a stone block being moved in the indexing direction. On the one hand, the stone block is not impeded in its indexing direction; on the other hand, it is still machined in an abrasive manner by the impact member. It is advantageous for the cylindrically designed impact member or its rotation axle to be arranged in an elastic or resilient manner, such that the impact member can optionally yield backward or yield when coming in contact with the stone block.

It is advantageous for the aging duct to have a second side wall which runs substantially parallel to the first side wall. The first and the second side walls thus form the side walls of the aging duct.

The second side wall may be, in principle, designed like the already described first side wall. However, the second side wall may optionally also only be configured from a side wall, preferably made of metal, which, for example, runs in a substantially linear or unbent or flat manner. The second side wall may optionally be provided with abrasive elements in the case where machining of both side walls of the stone block is intended. However, the second side wall may also be used only for delimiting purposes or in order to configure an aging duct which is delimited on both sides, i.e. in order to avoid that the stone blocks leave the aging duct.

It is advantageous for the second side wall to be configured in a substantially mirror-imaged manner to the first side wall.

A particularly advantageous configuration results when both side walls are configured as parts of a piece of pipe—in the manner already described with respect to the first side wall. It may be provided here that both side walls, when they are assembled, form a completely closed pipe. However, it may also be provided that a longitudinal slot remains, in particular on the upper side of the pipe. Since the upper side of the stone block in most cases does not need to be machined within the scope of the device according to the invention, it is not necessary to invest material in this region. It is initially merely provided according to the invention that the upper side of the stone block is machined in that region which adjoins the stone-block upper edge of the side wall to be machined.

It is advantageous for the side walls to be configured by a piece of pipe or two parts of a piece of pipe. It is furthermore advantageous for the portions of the aging duct to be in each case configured by a piece of pipe or at least two parts of a piece of pipe.

It may be provided according to the invention that the angle between the first portion and the second portion and/or between the second portion and the third portion or further following portions is between 5° and 70°, preferably between 20° and 60°, particularly preferably between 20° and 45°.

It is furthermore advantageous for the conveying unit to introduce or convey a row of stone blocks which is formed by a plurality of individual stone blocks arranged behind one another into or through the aging duct. The conveying unit may convey the stone blocks through the aging duct, for example, in a continuous manner or at intervals.

The configuration of the conveying unit, for example by way of a conveying ram, a conveyor belt or a conjointly running conveying member, is not relevant in the context of the present invention. However, it is advantageous for the angled arrangement of the portions to be designed such that a conveying ram, which is displaceable in a linear manner and which pushes the stone blocks through the aging duct, can be employed.

It may be optionally provided in one configuration of the invention for the base to run in an inclined manner, i.e. to slope downward in the indexing direction, such that the stone blocks move through the aging duct without any further conveying unit or with a correspondingly lower support by a conveying unit. Alternatively or additionally, a correspondingly oriented vibration, which causes a forward movement or a movement of the stone blocks in the desired indexing direction, may optionally also be provided.

The device according to the invention can be implemented in a particularly simple manner in that two, preferably three duct portions, which preferably have the shape of a pipe and optionally have a partially or fully open upper side, are placed next to one another in an angled manner. It is advantageous here for the portions designed in the shape of a pipe to be configured from metal and to be welded, screwed or riveted to one another. Here, the second portion can bend toward the left or the right in relation to the first portion, and the third portion can bend in a correspondingly opposite way toward the right or left, respectively. The portions in the shape of a pipe may, for example, also be assembled using two halves of cylinders. Multiple bending of the portions has proven suitable in particular also for the satisfactory aging of comparatively small stone blocks or for achieving that the rear vertical edge of a preceding stone block sufficiently impacts or abrades on the front vertical edge of a following stone block.

According to the invention, the stone blocks are preferably pushed through in lines. The impact faces can be configured in a particularly simple manner by way of welding seams on the positions provided according to the invention.

It is advantageous for a plurality of aging ducts to be configured on the base in each case for one row of stone blocks. In order to minimize the space requirement, the aging ducts may be configured to lie tightly against one another. It may be advantageous here for the first portion to run at an angle or an incline in relation to a longitudinal axis of the base, such that, on account of an angled bend, the second portion preferably runs parallel to the longitudinal axis of the base and the bend is again reversed in the third portion. In this manner, the width of the base can be minimized.

After having left the aging ducts, it is advantageous for the aged stone blocks to be brought together again, so that they can be transported onward in layers.

It may be provided here that the device according to the invention is combined with a device which manufactures the split blocks.

It may be provided in a method for the artificial aging of stone blocks, in particular of concrete blocks, clinker bricks and natural stone blocks, according to the invention that the stone blocks pass through an aging duct which is arranged on a base and on which the stone blocks can be laid with a lower side in such a manner that a side face of the stone block, which is to be machined, is oriented toward the side. It is provided here in the method according to the invention that the side face to be machined is delimited by a horizontally running stone-block lower edge, a horizontally running stone-block upper edge, a front vertically running stone-block edge and a rear vertically running stone-block edge. It is furthermore provided in the method according to the invention that the base is set to vibrate. It is furthermore provided in the method according to the invention that the aging duct has at least one first and one second impact face, whereby the stone blocks, on account of the motion of the base, impact on the impact faces in such a manner that the impact faces act upon the stone block in an aging manner. It is furthermore provided in the method according to the invention that the first impact face is oriented toward the horizontally running stone-block lower edge and the second impact face is oriented toward the horizontally running stone-block upper edge. Here, the first and the second impact faces are arranged according to the invention such that the first impact face also machines a part-face of the side face to be machined which adjoins the horizontally running stone-block lower edge and an adjoining part-face of a lower side of the stone block and the second impact face, in addition to the horizontally running stone-block upper edge, also machines adjoining part-faces of the side faces and of the upper side of the stone block. According to the method according to the invention, it is furthermore provided that the stone blocks which pass through the aging duct are forced into at least one change of direction. It is furthermore provided according to the invention that the stone blocks are conveyed through the aging duct as a row of stone blocks in which a plurality of individual stone blocks are arranged behind one another in the indexing direction.

It is advantageous for the stone blocks which pass through the aging duct to be forced into at least two changes of direction.

It may furthermore be advantageous for the row of stone blocks to be pushed through the aging duct.

It may furthermore be provided according to the invention that the row of stone blocks passes through the aging duct in a continuous manner or an indexing at intervals is provided.

The features which are described above with reference to the device according to the invention may also be employed individually or in any combination with one another within the scope of the method according to the invention.

Advantageous refinements and configurations are derived from the further dependent claims. In the following, an exemplary embodiment is illustrated in principle by means of the drawings, in which:

DETAILED DESCRIPTION

The exemplary embodiment shows a device for the artificial aging of stone blocks and describes a corresponding method according to the invention. The stone blocks used in the exemplary embodiment are what are referred to as split blocks which are preferably configured using concrete. However, both the device and the method according to the invention are not limited thereto; rather, all features illustrated in the following may also be employed in the case of any other stone blocks, in particular natural stone blocks and clinker bricks, irrespective of whether they have a split surface or not.

Figure 1:
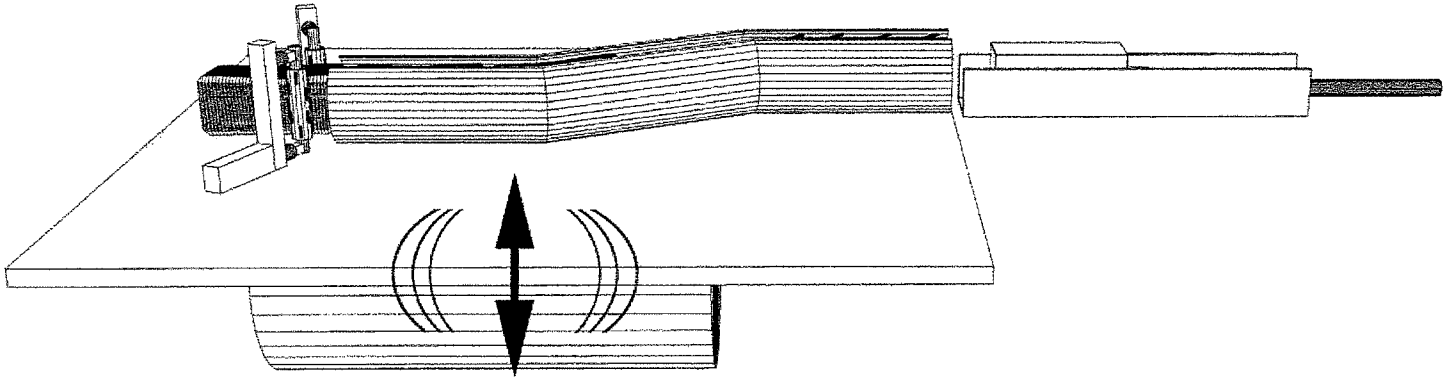
FIG. 1 shows a perspective view of the device according to the invention.

As emerges from FIG. 1, the device according to the invention has a base 1. An aging duct 3, which will be described in yet more detail in the following, is arranged on the base 1. Stone blocks 2, illustrated in more detail in FIGS. 2 and 3 and having a lower side 202, can be laid onto the base 1 or into the aging duct 3 in such a manner that an upper side 201 faces upward. A face of the stone block 2, which, in the direction of material flow through the aging duct 3, lies at the front, represents the front side 205, and a face of the stone block 2, which, in the direction of material flow, lies at the rear, represents a rear side 204. The direction of material flow of the stone blocks 2 through the device according to the invention or the aging duct is illustrated in the exemplary embodiment by the directional arrow A in FIGS. 1, 2 and 9.

It is provided in the exemplary embodiment that the upper side 201 of the stone block 2 is situated on the top when the stone block 2 is used in construction or laid at a later stage.

In relation to the direction of material flow (arrow A) and the upper side 201, the stone blocks 2 have two side faces 200 and 203, respectively, which are oriented toward the side. The side faces 200 and 203, respectively, run substantially perpendicularly in relation to the front side 205 and the rear side 204, respectively, and to the upper side 201 and to the lower side 202.

Machining of both side faces 200 and 203, respectively, is illustrated in the exemplary embodiment. However, in most cases machining of one side face 200, which will be referred to in the following as the side face 200 to be machined, will suffice.

Figure 3:
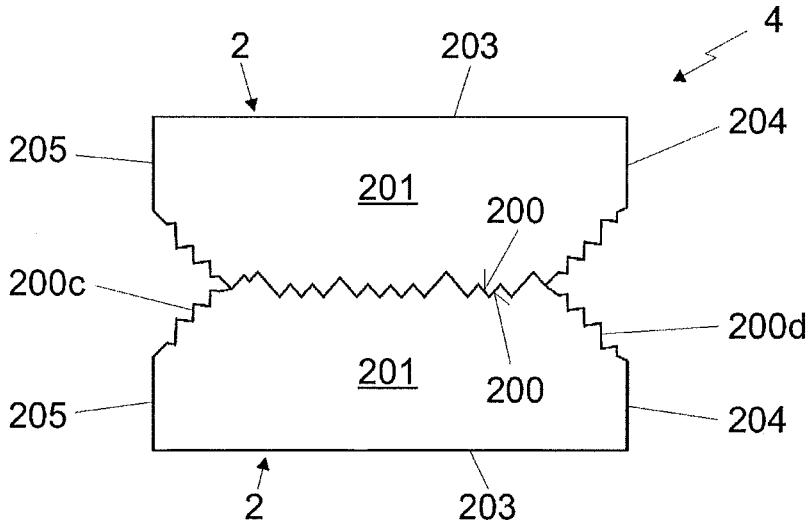
FIG. 3 shows a plan view of a block from which two split blocks are manufactured.
Figure 4:
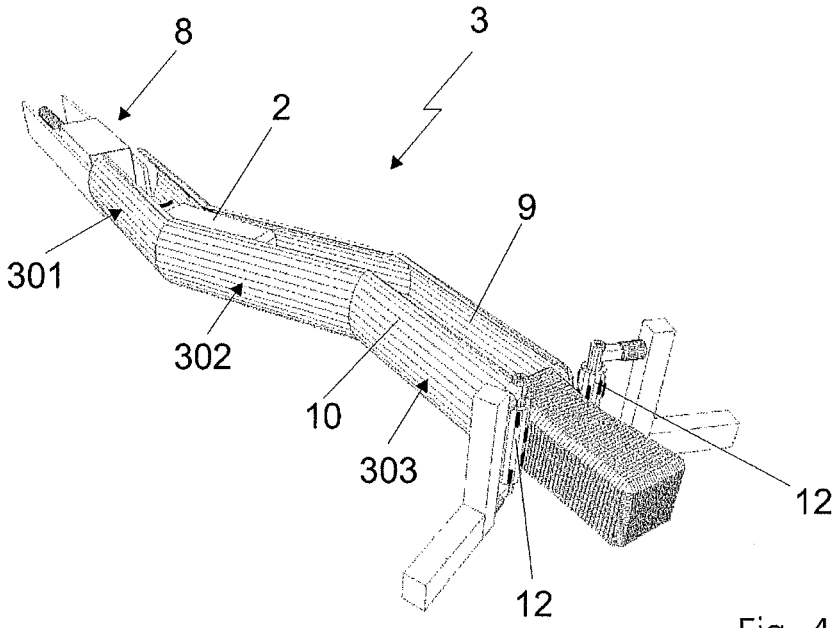
FIG. 4 shows a perspective illustration onto the aging duct according to the invention.
Figure 5:
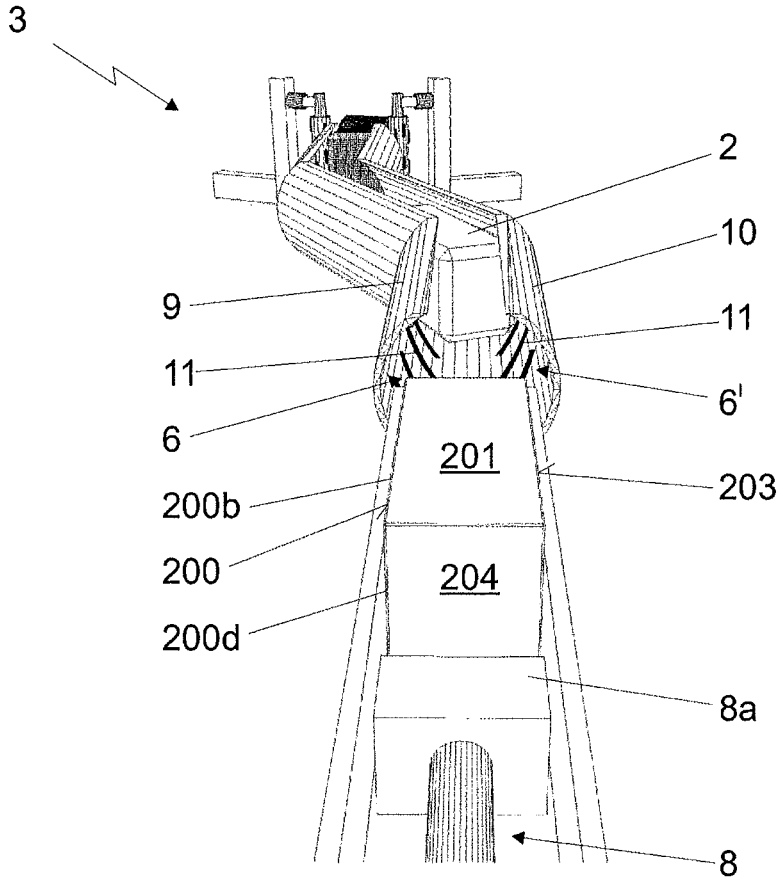
FIG. 5 shows a view of the aging duct in the conveying direction.
Figure 6:
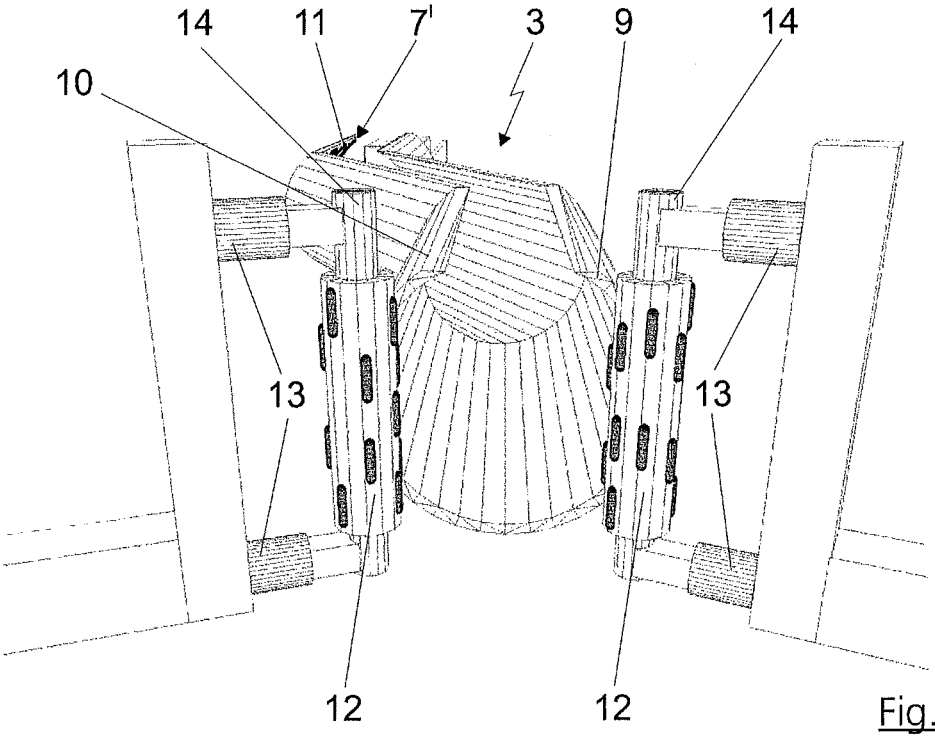
FIG. 6 shows an illustration of the end region of the aging duct which is provided with impact members.
Figure 7:
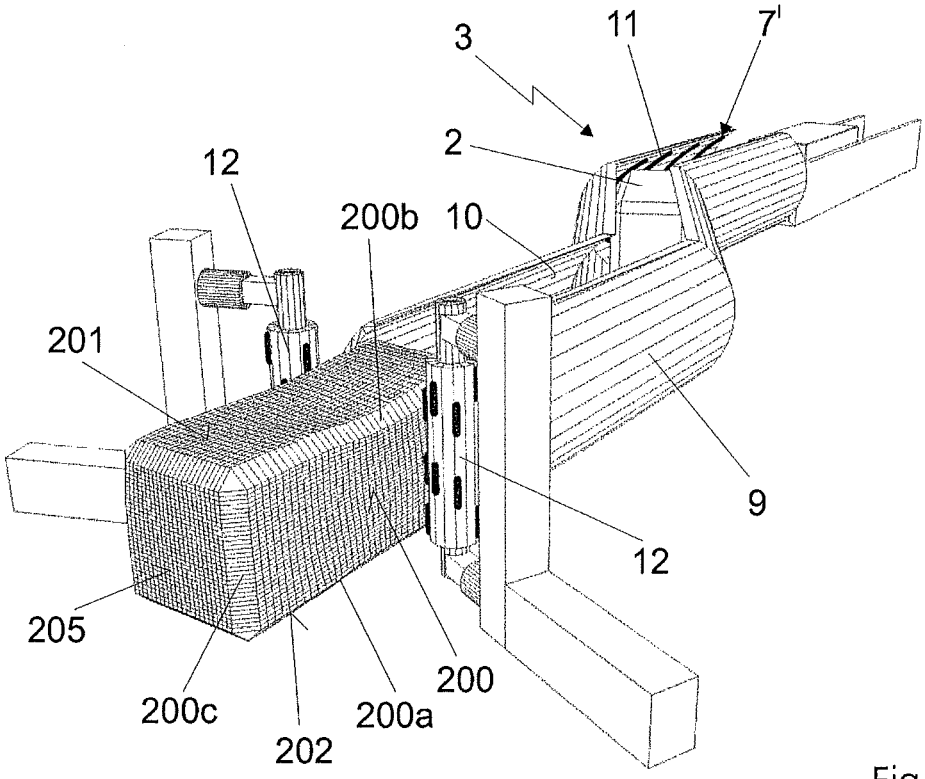
FIG. 7 shows a further perspective illustration of the end region of the aging duct, wherein a stone block is being conveyed through between the impact members.

As emerges from FIG. 3, split blocks 2 are produced by splitting a larger block of stone 4. The split blocks 2 here substantially have a broken surface on a side face 200. Often, the stone blocks 2 are also laid to form an assembly in such a manner that only the side face 200 and the adjoining edges can be seen. The solution according to the invention is, however, also suitable when not only the side face 200 to be machined but also the side face 203, which is oriented toward the opposite direction, is to be machined.

The features described in the exemplary embodiment are suited to both the aging of only one side face 200 as well as to the analogous aging of both side faces 200 and 203, respectively.

Figure 2:
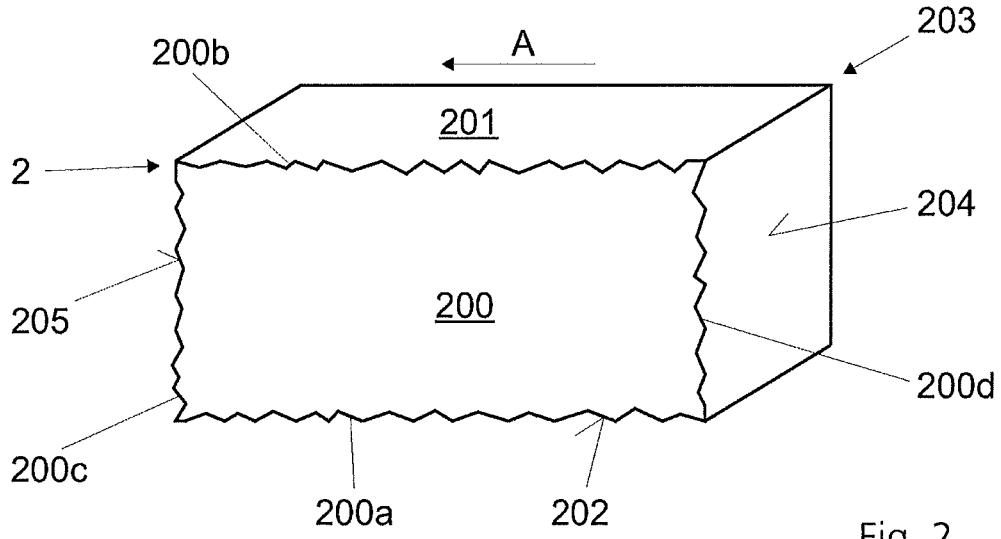
FIG. 2 shows a perspective view of a stone block to be aged.

As emerges from FIG. 2, the side face 200 to be machined of the split block 2 is delimited by a horizontally running stone-block lower edge 200*a*, a horizontally running stone-block upper edge 200*b*, a front vertically running stone-block edge 200*c* and a rear vertically running stone-block edge 200*d*. The stone-block lower edge 200*a* and the stone-block upper edge 200*b* run substantially parallel to the direction of material flow A, once the stone block 2 has been introduced into the aging duct 3.

The direction of material flow A substantially represents a main indexing direction. As will be shown in more detail in the following, it is provided in the exemplary embodiment for the aging duct 3 to be designed such that the stone blocks which pass through the aging duct 3 perform two changes of direction. Nevertheless, the stone blocks 2, in overall terms, move in the direction of the arrow A in relation to the entire aging duct 3.

As emerges from FIG. 1, a vibration unit 5 is provided for setting the base 1 in motion. The vibration unit 5 can be designed in any manner; for example, jogging motors can be used. The motion of the base 1 is indicated by way of the double arrow in FIG. 1. In the exemplary embodiment, the base 1 moves in such a manner that the stone blocks 2 lying thereon, substantially on account of the vibration, move upward and downward, i.e. they "jump" on the base 1 or in the aging duct 3. In the exemplary embodiment, the direction of motion is therefore a movement perpendicular to the direction of material flow or perpendicular to the base 1.

In an optional embodiment not illustrated in more detail, a rotatable mounting of the base 1 may be provided. It may be provided to this end that the base 1 is rotatably mounted by means of a rotation axle or a rotation shaft, such that the base 1 can perform a movement in the shape of an arc about a longitudinal axis. The stone blocks 2 lying on the base 1 are thus moved to the side, i.e. toward the right and the left, when viewed in the direction of material flow.

Figure 10:
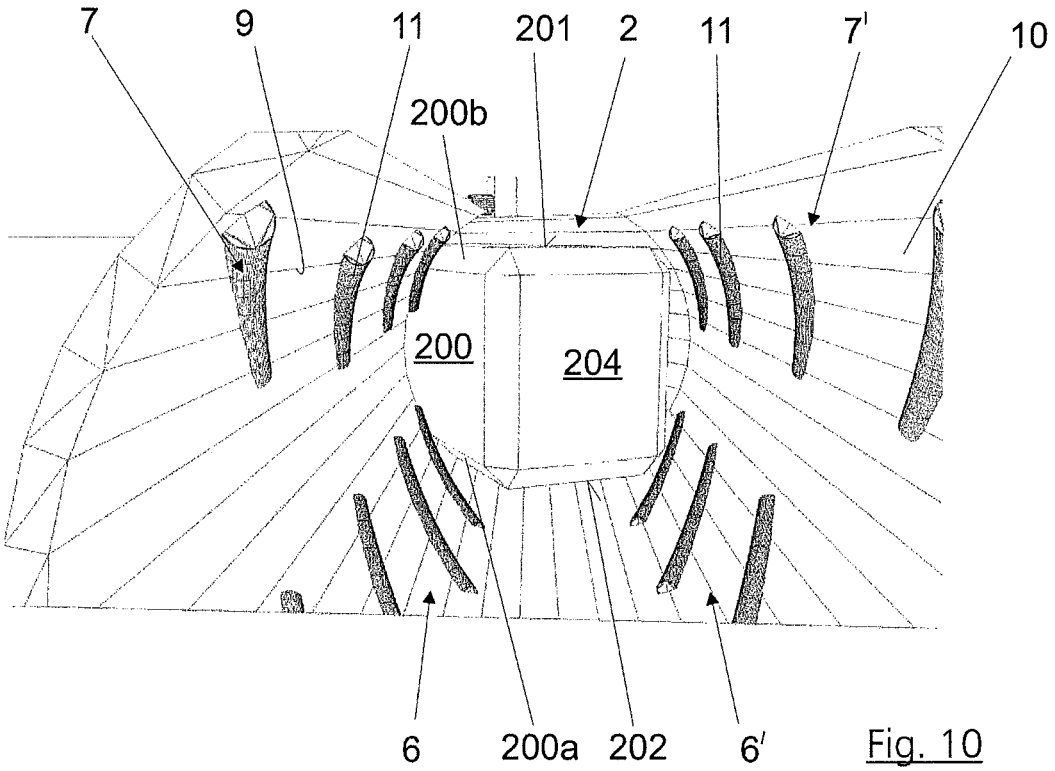
FIG. 10 shows an enlarged illustration of the aging duct in a region in which the first portion merges with the second portion.

As emerges from FIGS. 1, 4, 5, 6, 7 and 11, in particular from FIG. 10, the aging duct 3 has at least first impact faces 6 and second impact faces 7. On account of the motion of the base 1 or of the vibration unit 5, the split blocks 2 impact on the impact faces 6, 7 in such a manner that the impact faces 6, 7 act in an aging manner on the stone block 2. As emerges from the figures, the first impact face 6 is oriented toward the horizontally running stone-block lower edge 200*a* and the second impact face 7 is oriented toward the horizontally running stone-block upper edge 200*b*. The first impact face 6 is thus configured at the bottom of the aging duct 3, and the second impact face 7 is configured at the top of the aging duct 3.

The stone blocks 2 impact on the second impact face 7 when, on account of the vibration, the stone blocks 2 jump upward. The stone blocks 2 impact on the first impact face 6 when the stone blocks 2 fall downward again or, on account of the vibration, are pushed upward.

The first impact face 6 is arranged such that a part-face of the side face 200 which adjoins the horizontally running stone-block lower edge 200*a* and an adjoining part-face of a lower side 202 of the stone block 2 are also machined. The part-faces are preferably edge strips of the lower side 202 or of the side face 200, respectively, which adjoin the stone-block lower edge 200*a*.

The second impact face 7 is arranged such that, in addition to the horizontally running stone-block upper edge 200*b*, also adjoining part-faces of the side face 200 and of the upper side 201 of the stone block 2 are machined. The part-faces may be edge strips.

It is advantageous for the aging duct 3 to have at least two portions 301, 302. It is provided in the exemplary embodiment that the aging duct 3 has three portions 301, 302 and 303. It is provided here that the stone block 2 passes through the first portion 301 in a first indexing direction. The second portion 302 here is arranged at an angle or runs at an angle in relation to the first portion 301, i.e. is not parallel to the first portion 301, such that the stone block 2 is deflected in its indexing direction and moves in a second indexing direction which is necessitated by the second portion 302.

The third portion 303 runs at an angle in relation to the second portion 302, such that the split block 2 is in turn deflected and moves in a third indexing direction. In the exemplary embodiment, the third indexing direction corresponds at least approximately, preferably exactly to the first indexing direction. The stone block 2 is thus deflected to the side by the second portion 302 in the plane predetermined by the base 1; in the exemplary embodiment, when viewed in the direction of material flow, to the left. In the third portion 303, the stone block 2 is in turn deflected to the side in the plane of the base 1; in the exemplary embodiment to the right.

It is advantageous for the stone blocks to be deflected in opposite directions in the case of two changes of direction.

Figure 8:
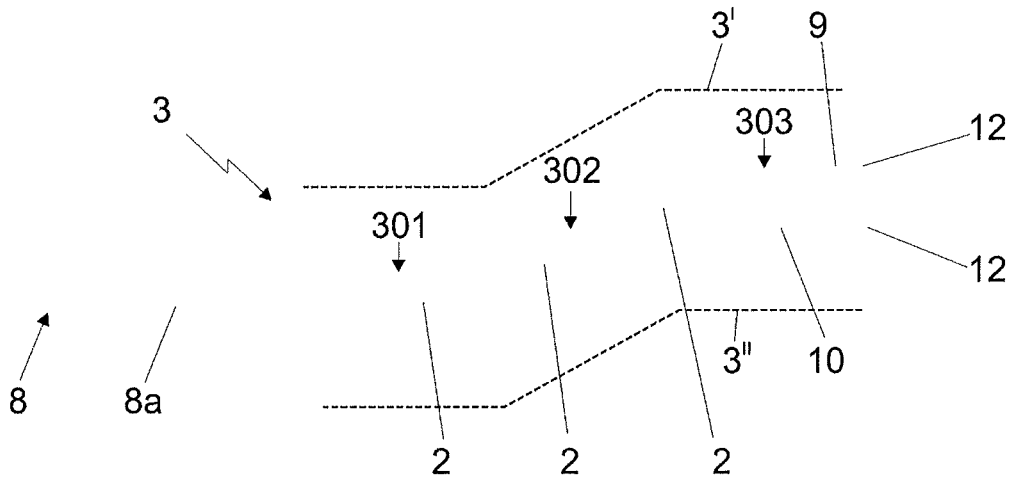
FIG. 8 shows a plan view of the aging duct according to the invention.
Figure 9:
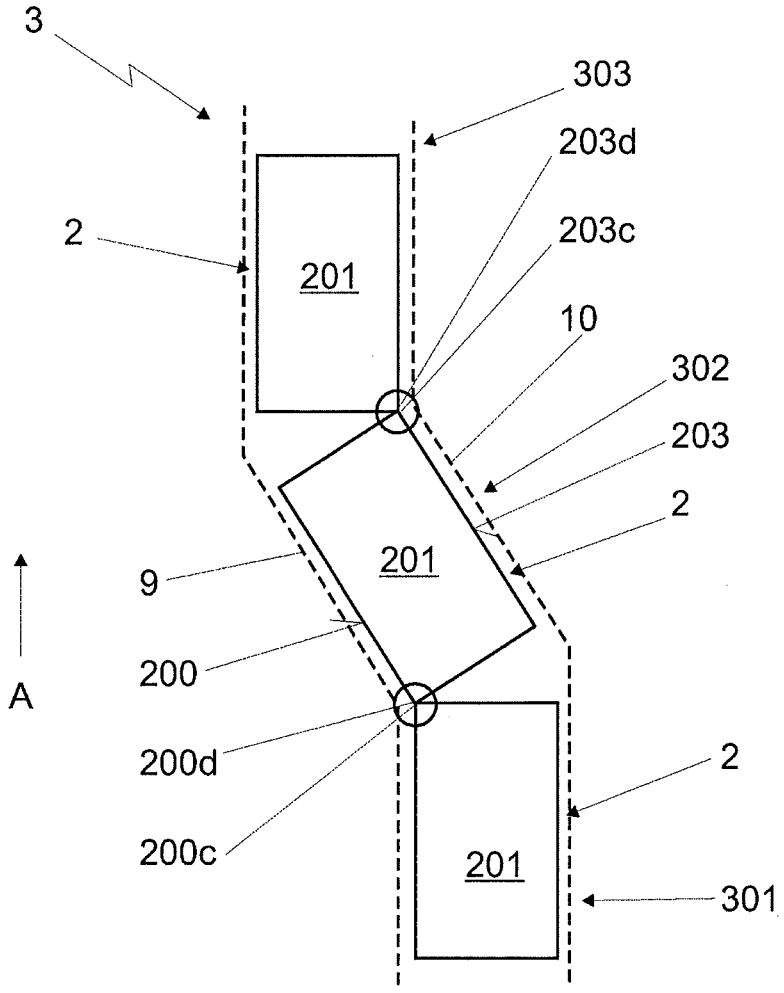
FIG. 9 shows an in-principle illustration of the collision between a horizontally running side edges of a preceding and a following stone block.

The change of direction performed by the stone blocks 2 when passing through the portions 301, 302 and 303 has an effect which is important for aging and which, illustrated in principle, emerges particularly well from FIG. 9 and FIG. 8.

The deflection of the stone blocks leads to a rear vertically running stone-block edge 200*d* of a preceding stone block 2 impacting on the front vertically running stone-block edge 200*c* of a following stone block 2 when two (or more) stone blocks 2 pass through the aging duct 3. On account of this, both edges 200*d*, 200*c* are aged. On account of the vibration of the base 1 the aging effect here is even increased. The collision can be seen particularly well in FIG. 9. It also emerges from FIG. 9 and FIG. 8 that in turn a collision between a front vertically running stone-block edge 203*c* of a following stone block 2 and a rear vertically running stone-block edge 203*d* of a preceding stone block 2 is achieved on account of the third portion 303, i.e. the second, opposite change of direction. Where the aging duct 3 has three portions, i.e. the aging duct 3 twice forces the stone blocks 2 into a change of direction, it is therefore achieved that in total all vertically running stone-block edges of the stone block 2 are aged by way of a collision with an adjoining, preceding or following stone block.

It is of advantage that a conveying unit 8 for conveying the stone blocks 2 through the aging duct 3 is provided. For the sake of clarity, a plurality of stone blocks 2 which are moved through the aging duct 3 by a conveying unit 8 are illustrated merely in FIG. 8 and FIG. 9. The conveying unit 8 here may be designed in any manner. In the exemplary embodiment it is provided for the conveying unit 8 to have a ram 8*a*. On account of a suitable arrangement of the ram 8*a* and of a correspondingly small dimensioning (not illustrated in FIG. 8*a*) it can be achieved that the ram 8*a* can be pushed almost entirely through the aging duct 3. This may also depend on the angular positioning of the individual portions 301, 302 and 303 in relation to one another and on their respective lengths. However, a multiplicity of variants for conveying the stone blocks 2 through the aging duct 3 are conceivable. For example, a chain conveyor, which is arranged above the base 1 and on which corresponding push links engaging from above into the aging duct 3 and moving forward together with the stone block 2 are arranged, may also be provided.

It is provided in the exemplary embodiment that the aging duct 3 has one first side wall 9 and one second side wall 10. The side walls 9, 10 here are, when viewed in the cross section, shaped in the form of an arc or run from the bottom, i.e. when viewed from the base 1, to the top in the shape of an arc. It is provided in the exemplary embodiment that the side walls 9, 10, when viewed in the cross section, configure a divided circle.

A configuration of the side walls 9, 10 as a channel or as a piece of pipe cut in the longitudinal direction has proven to be particularly suitable.

It may be provided that the side walls 9, 10 are connected to one another in a lower region, for example by way of a plate-shaped element. Alternatively or additionally, the side walls 9, 10 may also be connected to one another in an upper region for the purpose of increasing stability.

It has proven to be advantageous for the side walls 9, 10 to be two-dimensionally connected to one another across the entire aging duct 3 in the lower region, such that no depression or holes, in which the stone blocks 2 which are being conveyed through can get jammed, are created. A connection is not necessary per se in the upper region of the side walls 9, 10, but may be advantageous in order to increase stability. In order to save material and, if applicable, to observe the aging process, a connection of the side walls 9, 10 in the upper region may also take place only partially.

It is indicated in the exemplary embodiment that the first side wall 9 and the second side wall 10 are made from a shared pipe. This is an optional measure. In this case, the floor of the aging duct 3, which is oriented toward the base 1, is provided by the pipe which configures the side walls 9, 10. However, the specific design of the aging duct 3 is not of major significance for carrying out the aging process or for implementing the device according to the invention.

The floor of the aging duct 3 may also be formed by the base 1.

Figure 11:
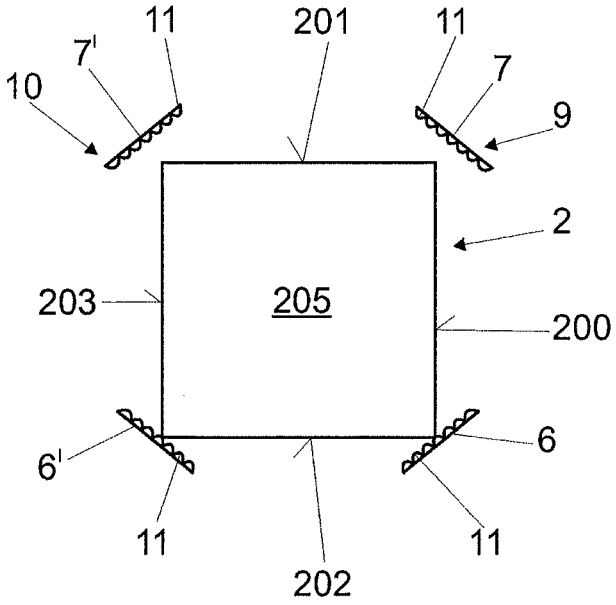
FIG. 11 shows an in-principle illustration of an alternative design of the impact faces of the aging duct.

FIG. 11 shows, in an in-principle illustration, an alternative configuration. Here it is provided that the first impact face 6 and the second impact face 7 are formed only by plates which are oriented toward the horizontally running stone-block lower edge 200*a* or the horizontal running stone-block upper edge 200*b*, respectively. The impact faces, or the plates which configure the impact faces, are at an angle in relation to both the upper side 201 and the lower side 202, respectively, of the stone block 2, as well as to the side face 200. It is thus achieved that edge strips, which have already been described above and which adjoin the stone-block lower edge and the stone-block upper edge, respectively, are conjointly machined or aged. The illustration according to FIG. 11 shows that it is not a matter of the specific design of the aging duct 3 when it comes to aging horizontally running stone-block edges 200*a*, 200*b* by means of the impact faces 6, 7. In FIG. 11, two first impact faces 6, 6' and two second impact faces 7, 7' are illustrated, such that the stone-block upper edges and the stone-block lower edges of both the side face 200 and also of the side face 203 can be machined. Again, this is also optional.

It is of advantage for the first side wall 9 or, in a complementary manner, also the second side wall 10 to have impact faces 6, 7 or 6', 7', respectively.

The impact faces 6, 7 preferably extend across the entire length of the aging duct 3. However, it may also be provided that the impact faces 6, 7 only extend across a part-length of the aging duct 3 or only across one or more portions 301, 302 or 303.

As emerges from FIG. 10, it may be provided that the lower region of the side wall 9 is bent in such a manner that the first impact face 6 which is configured there embraces both the horizontally running stone-block lower edge 200*a* of a stone block 2 and also the adjoining part-faces of the side face 200 and of the lower side 202 of the stone block 2. It may be furthermore provided that the upper region of the side wall 9 is designed in such a manner that it embraces both the horizontally running stone-block upper edge 200 and also the adjoining part-faces of the side faces 200 and of the upper side 201 of the stone block 2.

A configuration of the side wall 9 bent in such a manner can be achieved in a particularly simple manner when the side wall 9 is part of a pipe or of a piece of a pipe. A bent side wall 9 can, however, also be achieved with other means, for example by bending a metal sheet or by other forming processes. It is illustrated in FIG. 10 that both side walls 9, 10 are identically designed. Again, this is also optional.

The impact faces 6, 7 may be configured with abrasive elements and/or tips and/or protrusions and/or welding points and/or welding beads and/or an irregular structure. As emerges in particular from FIG. 10, the configuration of welding beads 11 is provided in the exemplary embodiment. In the exemplary embodiment, the aging duct 3 is configured substantially from metal, preferably a hard metal, particularly preferably steel. It may be of advantage in particular for at least the side walls 9 and/or 10 of the aging duct 3 to be configured from metal. In this case, the impact faces 6, can be equipped with welding beads 11, or correspondingly configured, in a particularly simple manner.

The impact faces 6, 7 here may be provided with the aforementioned abrasive elements, welding beads 11 and similar in an irregular manner. It is only for the sake of a simplified illustration that a regular arrangement of welding beads 11 is illustrated in FIG. 10. However, the exemplary embodiment is not limited thereto.

Additional impact members which are positioned in a stationary manner and/or are positionable in a controlled manner may be provided within the scope of the invention, such that, on account of the vibration motion of the base 1, bevels and/or recesses and/or angles of the side face 200 to be machined impact thereon. Alternatively, this may also be provided for the side face 203.

The impact members may be designed and introduced into the indexing path of the split blocks 2 in any manner. A possible configuration of additional impact members 12 is provided in FIGS. 4, 6, 7 and 8. Here, a pair of impact members 12 is provided. One of the impact members 12 here acts on the side face 200 and the other on the side face 203. This is, however, optional. It is, likewise optionally, provided in the exemplary embodiment for the impact members 12 to be positioned by means of an elastic or flexible element 13 in such a manner that, on account of the vibration motion of the base 1, bevels and/or recesses and/or angles and/or bulges and/or protrusions of the side faces 200, 203 to be machined impact thereon. Optionally, the impact members 12 may additionally vibrate. In general, however, the vibration of the base 1 suffices. In the exemplary embodiment it is illustrated that—again optionally—the impact members 12 constrict the available space, in particular the width of the aging duct 3, for passing through the stone blocks 2 in such a manner that the stone blocks 2 are pressed against the impact members 12, wherein the impact members 12, on account of the elastic or flexible elements 13, can yield when the stone block 2 is conveyed through the aging duct 3 in the indexing direction.

In the exemplary embodiment, the impact members 12 are rotatably arranged on a vertically running axle 14. When the stone block 2 comes into contact with the impact members 12, the impact members 12 can, therefore, rotate on the axle 14, such that conveying through a stone block 2 is simplified. The impact members 12 nevertheless age the side faces 200, 203. Positioning of the impact members 12 may take place depending on the width of the stone blocks 2, such that the aging duct 3 can be constricted or widened if and when necessary.

The impact members 12 illustrated in the exemplary embodiment may be freely positioned within the aging duct 3. It may be provided that the aging duct 3 has openings which are suited to the insertion of the impact members 12. On account of this, a guide through the aging duct 3 or through the aging line is furthermore provided. However, it is also possible for the impact members 12 to be arranged at the end or at the beginning of the aging duct 3, as is illustrated in the exemplary embodiment.

It is of advantage for the portions 301, 302 and 303 of the aging duct 3 to be in each case configured by a piece of pipe or at least two part of a piece of pipe which is preferably connected to one another.

The angle between the first portion 301 and the second portion 302 and/or between the second portion 302 and the third portion 303 may be, for example, between 5 and 70°, preferably between 20 and 60°, particularly preferably between 30 and 45°. The selection of a suitable angle may be made depending on the hardness of the stone block 2, the intensity of the vibration and the desired aging result.

The conveying unit 8 may be configured in such a manner that the stone blocks 2 are conveyed through the aging duct 3 in a continuous manner. However, it may also be provided that the conveying unit 8 conveys the stone blocks 2 through the aging duct 3 at intervals. It may be provided here, for example, that the conveying unit 8 in each case pushes one or more stone blocks 2 into the aging duct 3. The stone blocks 2 can then be aged during a specific interval, without the stone blocks 2 being moved in the direction of material flow A. During this interval, the conveying unit 8 can make available further stone blocks 2 which are then pushed into the aging duct 3 once the interval has expired. On account of this, all stone blocks 2 which are already situated in the aging duct 3 are conveyed onward in the direction of material flow A.

It is of advantage for the stone blocks 2 to be pushed through the aging duct 3 as a row of stone blocks in which a plurality of individual stone blocks are arranged behind one another in the indexing direction. This may take place in a continuous manner or at intervals. It is of advantage here for the aging duct 3 to be in each case adapted to one line which is formed by a row of stone blocks arranged behind one another. It has proven to be particularly advantageous to push the stone blocks 2 through the aging duct 3 individually behind one another. Preferably two, three, four, five or more aging ducts 3 may be arranged on one base 1 here. In order to achieve a space-saving arrangement it has proven to be advantageous to arrange the aging ducts 3 parallel to one another. A configuration of a plurality of aging ducts 3 on one base 1 additionally has the advantage that, after having left the aging duct 3 again, the split blocks 2 can be brought together in a rapid and simple manner and be transported from there in layers. Furthermore, when viewed in the direction of material flow, a layer of stone blocks can be, for example, laid out in front of the aging duct 3 such that the stone blocks can be divided into lines which are then pushed into the individual aging ducts 3.

Two further aging ducts 3', 3" are illustrated using dashed lines in FIG. 8.

It is of advantage for the aging duct 3 to be designed such that the stone blocks 2 can move in the aging duct 3. The movement is provided in order for the stone blocks 2 to be able to jump upward and downward in the aging duct 3, preferably a pipe. On account of the stone blocks 2 being able to move in the aging duct 3, an irregular aged appearance also results, since the stone blocks 2 impact irregularly on the impact faces 6, 7 or on one another.

The exemplary embodiment, with respect to the space requirement of the stone blocks 2, is to be regarded as an in-principle illustration only.

It is of advantage for the aging duct 3 to be connectable to the base 1 by way of a rapid connection system. On account of this it becomes possible to replace the aging duct 3 in a rapid and simple manner when stone blocks 2 having another length or width or height are to be aged. The base 1 here may remain substantially unchanged.

While the foregoing constitute preferred embodiments of the invention according to the best mode presently contemplated by the inventors of making and carrying out the invention, it is to be understood that the invention is not limited to the particulars described above. In light of the present disclosure, various alternative embodiments and modifications will be apparent to those skilled in the art. Accordingly, it is to be recognized that changes can be made without departing from the scope of the invention has particularly pointed out and distinctly claimed in the appended claims as properly construed to include all legal equivalents.

What is claimed is:

1. A device for the artificial aging of stone blocks, in particular of concrete blocks, clinker bricks and natural stone blocks, comprising:

(a) a base and at least one aging duct which is arranged on the base and on which the stone blocks can be laid in such a manner that a side face of the stone block, which is to be machined, is oriented toward the side, wherein the side face to be machined is delimited by a horizontally running stone-block lower edge, a horizontally running stone-block upper edge, a front vertically running stone-block edge and a rear vertically running stone-block edge, (b) a vibration unit for setting the base in motion;

(c) wherein the aging duct has at least one first impact face and at least one second impact face, wherein the stone block, on account of the motion of the bases, impacts on the first and second impact faces in such a manner that the first and second impact faces act upon the stone block in an aging manner, wherein the first impact face is oriented toward the horizontally running stone-block lower edge and the second impact face is oriented toward the horizontally running stone-block upper edge and wherein the first and the second impact faces are arranged such that the first impact face also machines a part-face of the side face which adjoins the horizontally running stone-block lower edge and an adjoining part-face of a lower side of the stone block and the second impact face, in addition to the horizontally running stone-block upper edge, also machines adjoining part-faces of the side face and of the upper side of the stone block;

(d) the aging duct having at least a first portion and a second portion; wherein the stone block passes through the first portion in a first indexing direction and wherein the second portion runs at an angle in relation to the first portion, such that the stone block is deflected from the first indexing direction to move in a second indexing direction; and (e) a conveying unit for conveying the stone block through the aging duct.

2. The device as claimed in claim 1, wherein the aging duct has at least one third portion, wherein a third portion runs at an angle in relation to the second portion, such that the stone block is in turn deflected and moves in a third indexing direction.

3. The device as claimed in claim 1, wherein the aging duct has at least one first side wall which configures the first and/or the second impact face.

4. The device as claimed in claim 3, wherein the side wall, when viewed in the cross section, runs from bottom to top in the shape of an arc and is preferably configured in the shape of a divided circle or a semicircle.

5. The device as claimed in claim 3, wherein the side wall is configured as a channel or as a piece of pipe cut in the longitudinal direction.

6. The device as claimed in claim 3, wherein the lower region of the side wall is bent in such a manner that, when the stone block passes through the aging duct, the first impact face which is configured there embraces both the horizontally running stone-block lower edge of a stone block and also the adjoining part-faces of the side face and the lower side of the stone block, and wherein the upper region of the side wall is configured in such a manner that said upper region embraces both the horizontally running stone-block upper edge and also the adjoining part-faces of the side face and of the upper side of the stone block.

7. The device as claimed in claim 1, wherein the impact faces are configured with abrasive elements and/or tips and/or protrusions and/or welding points and/or welding beads and/or an irregular structure.

8. The device as claimed in claim 1, wherein the additional impact members, which are positioned in a stationary manner and/or are positionable in a controlled manner, are provided, such that, on account of the vibration motion of the base, bevels and/or recesses and/or angles of the side face to be machined impact on said additional impact members.

9. The device as claimed in claim 1, wherein the additional impact members, which are positioned by means of an elastic or flexible element in such a manner that, on account of the vibration motion of the base, bevels and/or recesses and/or angles and/or bulges and/or protrusions of the side face to be machined impact thereon, are provided, and/or the aging duct is constricted by the additional impact members such that the stone blocks are pressed against the impact members, wherein, on account of the elastic or flexible element, the impact members yield when the stone block is conveyed through the aging duct in the indexing direction.

10. The device as claimed in claim 8, wherein the impact members vibrate.

11. The device as claimed in claim 8, wherein the aging duct has at least one pair of impact members, wherein a first impact member is oriented toward the side face to be machined and a second impact member is oriented toward that side face of the stone block that faces away from the side face to be machined, such that the stone block passes through between the impact members.

12. The device as claimed in claim 3, wherein the aging duct has a second side wall which runs substantially parallel to the first side wall.

13. The device as claimed in claim 12, wherein the side walls are configured by a piece of pipe or two parts of a piece of pipe.

14. The device as claimed in claim 13, wherein the portions of the aging duct are in each case configured by a piece of pipe or at least two parts of a piece of pipe.

15. The device as claimed in claim 1, wherein the aging duct is configured from metal, preferably steel.

16. The device as claimed in claim 1, wherein the angle between the first portion and the second portion and/or between the second portion and the third portion is between 5 degrees and 70 degrees, preferably between 20 degrees and 60 degrees, particularly preferably between 30 degrees and 45 degrees.

17. The device as claimed in claim 1, wherein the conveying unit introduces a row of stone blocks which is formed by a plurality of individual stone blocks arranged behind one another into the aging duct.

18. The device as claimed in claim 17, wherein the conveying unit conveys the stone blocks through the aging duct in a continuous manner or at intervals.

19. A method for the artificial aging of stone blocks, in particular of concrete blocks, clinker bricks and natural stone blocks, (a) passing the stone blocks through an aging duct which is arranged on a base and on which the stone blocks can be laid with a lower side in such a manner that a side face of the stone block, which is to be machined, is oriented toward the side, wherein the side face to be machined is delimited by a horizontally running stone-block lower edge, a horizontally running stone-block upper edge, a front vertically running stone-block edge and a rear vertically running stone-block edge, (b) causing the base to vibrate;

(c) wherein the aging duct has at least one first and one second impact face; wherein the stone blocks, on account of the motion of the base, impact on the impact faces in such a manner that the impact faces act upon the stone block in an aging manner; wherein the first impact face is oriented toward the horizontally running stone-block lower edge and the second impact face is oriented toward the horizontally running stone-block upper edge and wherein the first and the second impact faces are arranged such that the first impact face also machines a part-face of the stone-block face which adjoins the horizontally running stone-block lower edge and an adjoining part-face of a lower side of the stone block and the second impact face, in addition to the horizontally running stone-block upper edge, also machines adjoining part-faces of the side faces and of the upper side of the stone block;

(d) forcing the stone blocks which pass through the aging duct into at least one change of direction; and (e) conveying the stone blocks through the aging duct as a row of stone blocks in which a plurality of individual stone blocks are arranged behind one another in the indexing direction.

20. The method as claimed in claim 19, wherein the stone blocks which pass through the aging duct are forced into at least two changes of direction.

21. The device as claimed in claim 19, wherein the row of stone blocks passes through the aging duct in a continuous manner or an indexing at intervals is provided.

* * * * *